United States Patent [19]

Chestney

[11] 4,077,629

[45] Mar. 7, 1978

[54] SEA BATTLE GAME APPARATUS

[75] Inventor: James K. Chestney, Alton, Ill.

[73] Assignee: Lawrence Peska Associates, Inc., New York, N.Y.

[21] Appl. No.: 764,224

[22] Filed: Jan. 31, 1977

[51] Int. Cl.[2] ..... A63B 67/00

[52] U.S. Cl. ..... 273/101

[58] Field of Search ..... 273/95 R, 96 R, 101, 273/101.2, 102 R, 1 R; 46/94

[56] References Cited

U.S. PATENT DOCUMENTS

| | | | |
|---|---|---|---|
| 3,336,030 | 8/1967 | Martell et al. | 273/101 |
| 3,342,492 | 9/1967 | Barrett | 273/101 X |
| 3,362,713 | 1/1968 | Miller | 273/95 R X |
| 3,414,716 | 3/1969 | Schwartz | 273/101 X |
| 3,434,717 | 3/1969 | Schwartz | 273/101 |
| 3,477,723 | 11/1969 | Djedda | 273/101 |
| 3,572,712 | 3/1971 | Vick | 273/101 X |
| 3,832,173 | 8/1974 | Cerankowski et al. | 96/3 |
| 3,843,127 | 10/1974 | Lack | 273/101 |
| 3,921,980 | 11/1975 | Artzer | 273/101 |
| 4,040,622 | 8/1977 | Sinnott | 273/101 X |

*Primary Examiner*—William H. Grieb

[57] ABSTRACT

A game for two or more players wherein each player is equipped with a water gun tethered to a small ship. Each water gun is provided with a hose to draw water from a pool in which the players are located and each ship is adapted to sink after its hull is filled with water. Each player attempts to sink the opponent's ship by squirting water into the opponent's ship which is deflected into the ship hull by sails on the ship while removing his own ship from the opponent's line of fire by pulling the tether.

3 Claims, 2 Drawing Figures

SEA BATTLE GAME APPARATUS

PRIOR ART

The following U.S. patents are considered pertinent:
Nos. 3,843,127
3,572,712
3,477,723
3,434,717
3,832,173
3,921,980
3,342,492
3,336,030

BACKGROUND OF THE INVENTION

This invention relates to a water game particularly adapted for playing in a swimming pool.

Due to the popularity of swimming pools, water games playable in such pools have enjoyed a corresponding increase in popularity.

It is an object of this invention to provide a water game that can be played with toys of simple and inexpensive construction.

It is a further object of this invention to provide a water game which promotes competition and enjoyment.

Further objects of this invention will become evident in view of the following detailed disclosure.

DETAILED DESCRIPTION OF THE PREFERRED EMBODIMENT

Figure 1:
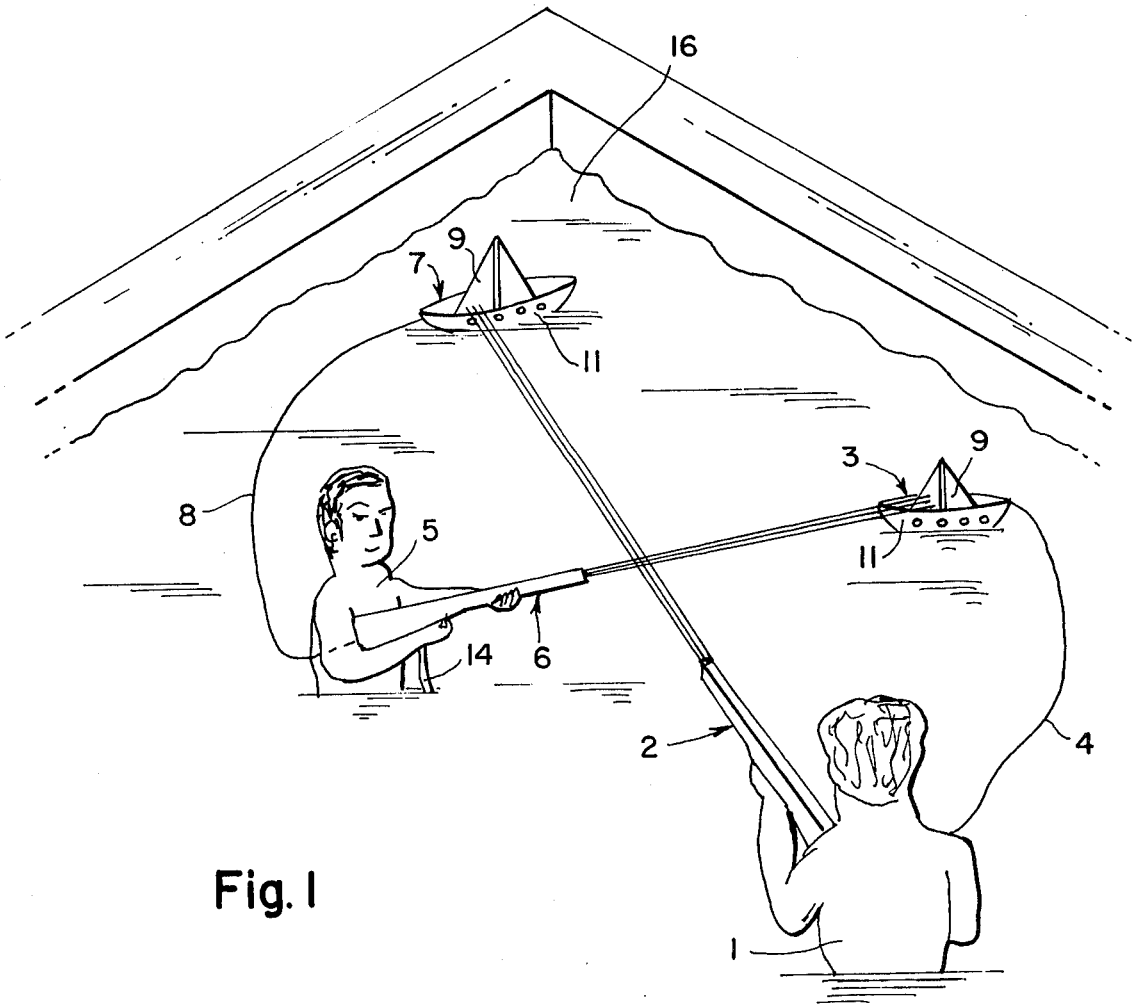
FIG. 1 is a perspective view representing the game as played.

Referring to FIG. 1, player 1 is equipped with a water gun 2 attached to ship 3 by the tether line 4. Player 5 also is equipped with a water gun 6 attached to ship 7 by a tether line 8. Each ship 3 and 7 is provided with a sail 9 positioned in hull 11 and made from a material which directs water from the guns 2 and 6 into the ship's hulls

11. The players 1 and 5 discharge water from the guns into the opponent's ship until one of the ships sink. The first player to sink his opponent's ship wins the game. During the game, each player moves his ship from the line of fire of his opponent by pulling the tether line of his gun.

Figure 2:
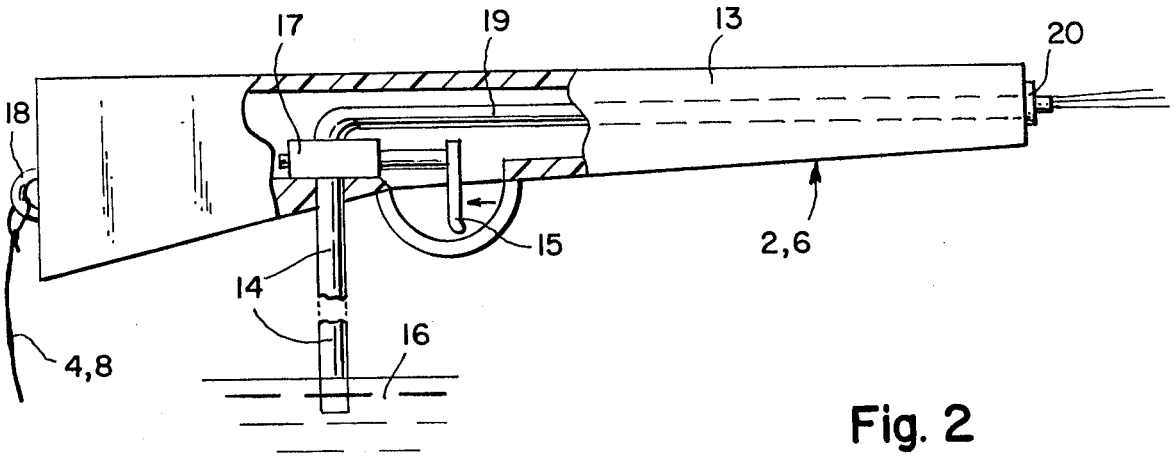
FIG. 2 is a side view in elevation, partially in cross-section of one of the toys used to play the game.

As shown in FIG. 2, the guns comprise a housing 13, an inlet hose 14, and a trigger 15 for controlling a water pump 17. The inlet hose 14 extends into the water 16 of the pool and communicates with pump 17. The hose 14 and pump 17 are filled when trigger 15 is depressed repeatedly and water under pressure is expelled through barrel tube 19 and out exit nozzle 20. The tether line 4 or 8 is attached to guns 2 or 6 by means of ring 18. It is to be understood that other suitable water guns may be employed in this game so long as it permits obtaining the water from the body of water in which the players are located. This invention is not limited to the embodiments specifically set forth above but includes modifications which are evident to the person skilled in the art.

I claim:

1. A water game for at least two players wherein each player is equipped with:

(a) a gun, a tether line attached to both said gun and a ship;

(b) said ship including means for directing water shot from a gun held by an opposing player into a hull thereof which sinks in water upon being filled with water;

(c) said gun including trigger means, means for pumping water from a body of water in which a player is positioned and actuable in response to operation of said trigger means, and nozzle means for directing water from said gun to an opponent's ship.

2. The game of claim 1 wherein said gun includes an elongated barrel through which water is pumped from said trigger means and out of said nozzle.

3. The game of claim 1 wherein said means on said ship for directing water to said hull includes a sail on said ship.

* * * * *